United States Patent [19]

Labrijn

[11] Patent Number: 4,910,869

[45] Date of Patent: Mar. 27, 1990

[54] ELECTRIC SHAVING APPARATUS

[75] Inventor: Hans Labrijn, Drachten, Netherlands

[73] Assignee: U.S. Philips Corp., New York, N.Y.

[21] Appl. No.: 370,159

[22] Filed: Jun. 20, 1989

[30] Foreign Application Priority Data

Nov. 24, 1987 [NL] Netherlands ..... 8702812
Apr. 13, 1988 [TW] Taiwan ..... 77102426

[51] Int. Cl.[4] ..... B26B 19/28
[52] U.S. Cl. ..... 30/43.6
[58] Field of Search ..... 30/43.4, 43.5, 43.6, 30/85-89, DIG. 1, DIG. 2

[56] References Cited

U.S. PATENT DOCUMENTS 3,458,737 7/1969 Lookman ..... 310/51
3,797,109 3/1974 Yamada et al. ..... 30/43.6 X
4,001,932 1/1977 Herrick ..... 30/43.5

FOREIGN PATENT DOCUMENTS 1410740 8/1965 France .
6509285 1/1967 Netherlands .
1083233 9/1967 United Kingdom .
1153790 5/1969 United Kingdom ..... 30/43.5

*Primary Examiner*—Douglas D. Watts
*Attorney, Agent, or Firm*—Ernestine C. Bartlett

[57] ABSTRACT

The invention relates to a shaving apparatus comprising a housing which can be used as a grip and a shaving head comprising at least one shaving unit, the shaving unit being inclined relative to the housing, which shaving unit comprises a stationary shaving member with hair-entry apertures and a rotatable shaving member, the rotatable shaving member being coupled to an electric motor by means of a drive spindle comprising two portions which are pivotable relative to one another, i.e. a first drive-spindle portion coupled to the rotatable shaving member and a second drive-spindle portion coupled to the motor. The housing is provided with a bearing by means of which the first drive-spindle portion is held in an inclined position relative to the second drive-spindle portion.

3 Claims, 2 Drawing Sheets

ELECTRIC SHAVING APPARATUS

This is a continuation of application Ser. No. 263,656, filed Oct. 27, 1988, now abandoned.

FIELD OF THE INVENTION

The invention relates to a shaving apparatus comprising a housing which functions as a grip and a shaving head comprising at least one shaving unit, the shaving unit being in an inclined position relative to the housing, which shaving unit comprises a stationary shaving member with hair-entry apertures and a rotatable shaving member, the rotatable shaving member being coupled to an electric motor by means of a drive spindle comprising two portions which are pivotable relative to one another, including a first drive-spindle portion coupled to the rotatable shaving member and a second drive-spindle portion coupled to the motor.

BACKGROUND OF THE INVENTION

Such a shaving apparatus is known, for example, from U.S. Pat. No. 4,257,161. It is desirable that during use of the apparatus the shaving head or at least the shaving unit is in an inclined position relative to the part of the housing which serves as a grip, so that the shaving unit can be brought in contact with the skin to be shaved without strenuous wrist action. In the known construction, where the axis of rotation of the motor and the axis of rotation of the rotary shaving member have the same direction, this means that the motor must be arranged in the shaving head, so that the shaving head becomes bulky and the weight distribution of the shaver becomes unfavorable.

SUMMARY OF THE INVENTION

It is the object of the invention to mitigate these drawbacks. To this end the housing is provided with a bearing by means of which the first drive-spindle portion is maintained in a position in which the direction of the axis of rotation of said portion deviates from the direction of the axis of rotation of the second portion.

Special embodiments are defined in the appended subsidiary Claims.

BRIEF DESCRIPTION OF THE DRAWING

Embodiments of the invention will now be described in more detail, by way of example, with reference to the Figures.

DETAILED DESCRIPTION OF THE PREFERRED EMBODIMENTS

Figure 1:
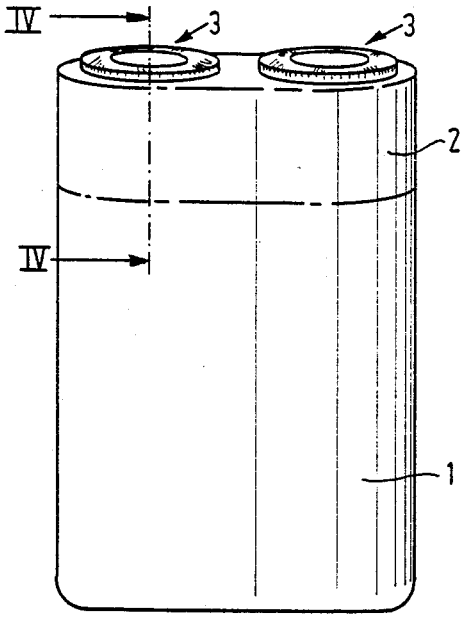
FIG. 1 is a front view of a shaving apparatus in accordance with the invention.

The shaving apparatus shown in FIGS. 1 to 4 comprises a housing 1 which functions as a grip, and a shaving head 2, the shaving head being inclined relative to the housing, so that the housing and the shaving head adjoin one another as a vee. The shaving head 2 comprises two shaving units 3, each comprising a stationary shaving member 4 with hair-entry apertures 5 and a rotatable shaving member 6.

Figure 2:
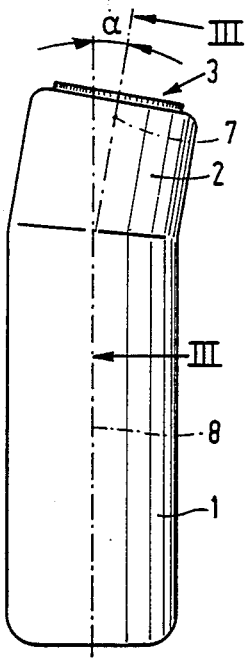
FIG. 2 is a side view of the shaving apparatus shown in FIG. 1.
Figure 3:
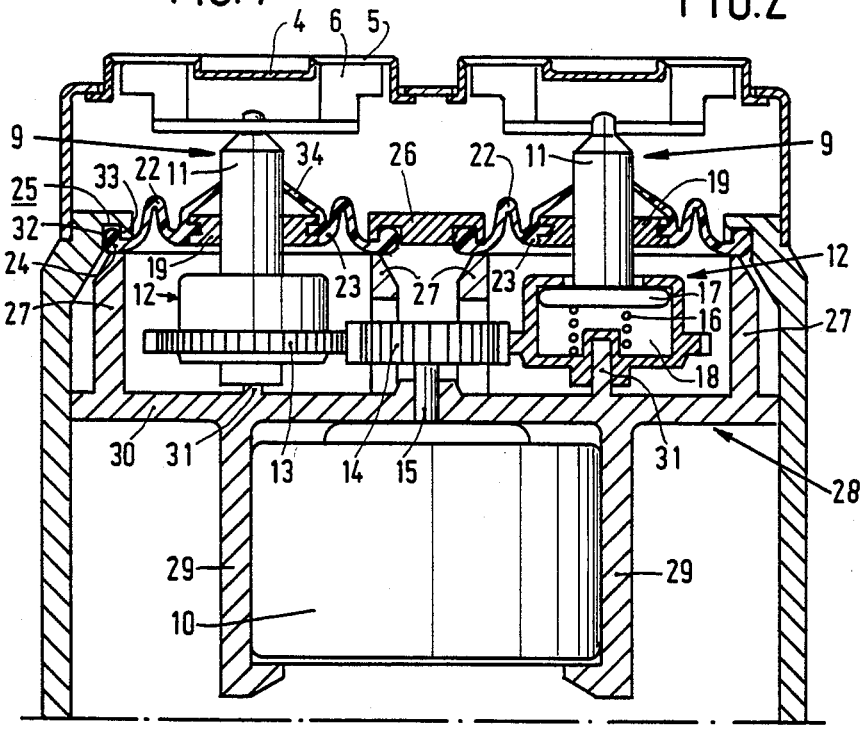
FIG. 3 is a sectional view taken on the line III—III in FIG. 2.
Figure 4:
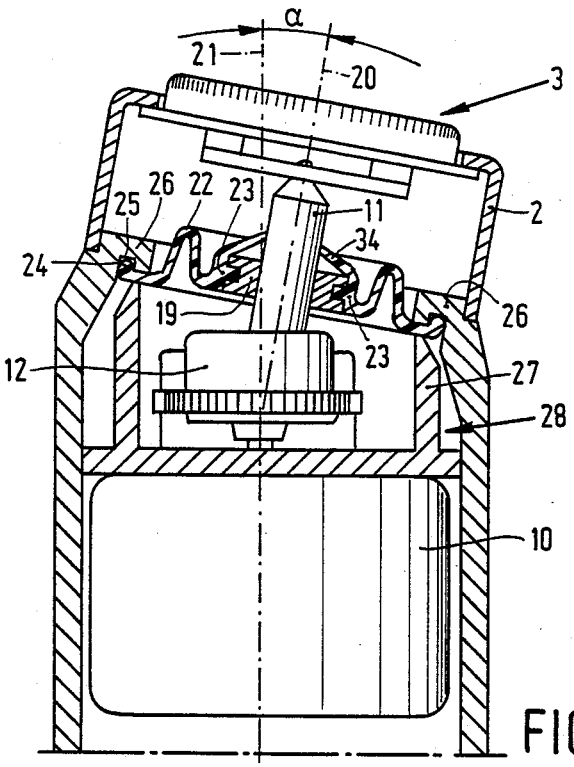
FIG. 4 is a sectional view taken on the line IV—IV in FIG. 1.

The inclined position of a shaving unit 3 relative to the housing 1 can be defined by the angle $\alpha$ between the axis of rotation 7 of a rotatable shaving member 6 and the longitudinal axis 8 of the housing (FIG. 2). Even a comparatively small value of $\alpha$, for example $\alpha=10°$, provides a considerable improvement in shaving convenience.

The rotatable shaving members 6 are coupled to an electromotor 10 by means of drive spindles 9. A drive spindle 9 of a construction known per se comprises a first drive-spindle portion 11 coupled to the rotatable shaving member 6 and a second drive-spindle portion 12 coupled to the motor 10. For this purpose the second drive-spindle portion 12 is provided with a toothed ring 13 which is in mesh with the central toothed wheel 14 on the motor shaft 15. A compression spring 16 arranged between the drive-shaft portions 11 and 22 provides the required pressure between the rotatable shaving members 6 and the stationary shaving member 4.

The first drive-spindle portion 11 has a flange 17 which engages in the space 18 in the second drive-spindle portion 12 to transmit the rotation of the drive-spindle portion 12 to the drive-spindle portion 11. The drive-spindle portion 11 can telescope relative to the drive-spindle portion 12 against the action of the spring 16 and is also pivotable to a limited extent relative to the drive-spindle portion 12.

The housing 1 is provided with a bearing 19 for the first drive-spindle portion 11 to hold the first drivespindle portion permanently in a tilted position relative to the second drive-spindle portion 12. This tilted position is such that the axis of rotation 20 of this drive spindle portion 11 (FIG. 4), which axis coincides substantially with the axis of rotation 7 of the rotatable shaving member 6, is oriented at the desired angle $\alpha$ relative to the axis of rotation 21 of the second drive spindle portion 12, which substantially coincides with the longitudinal axis 8 of the housing 1.

Preferably, the bearing 19 is constructed as a part of an at least partly flexible sealing element 22. This sealing element comprises an annular rubber cup 23, which surrounds the bearing 19, and a circumferential sealing lip 24. This lip engages a groove 25 in the inclined end wall 26 of the housing 1.

The sealing lip 24 is retained by means of an annular member 27 which forms part of a frame 28 which also carries the motor 10. To this end the frame 28 comprises hooks 29 which engage underneath the motor 10. The frame comprises a frame plate 30 carrying the journals 31 for the second drive-spindle portions 12, so that these second drive-spindle portions are also mounted on the frame. This greatly simplifies mounting of the motor 10 and the drive spindles 9, whilst at the same time the sealing element 22 is retained. The sealing lip 24 mainly provides sealing relative to the upright walls 32 and 33 of the groove 25.

For driving the shaving units 3, which are inclined relative to the housing, the above construction utilizes the possibilities offered by the existing pivotal drive spindles 9. As a result of this special additional parts such as flexible shafts or bevel-gear transmissions are not needed. The motor 10 can be accommodated in the housing 1, so that the centre of gravity is situated in the housing and the apparatus is convenient to handle. The shaving head 2 comprises only the shaving units 3 and parts of the drive spindles 9, which provides more freedom with respect to the design of the shaving head.

Alternatively, the bearing 19.can be mounted directly in the housing wall 26 of the housing. However, the use of the sealing element 22 results in an apparatus which may be cleaned with water. The sealing of the drive-spindle portions 11 can be further improved by providing the rubber cup 23 with a lip 34 adjoining the drive-spindle portion 11.

Figure 5:
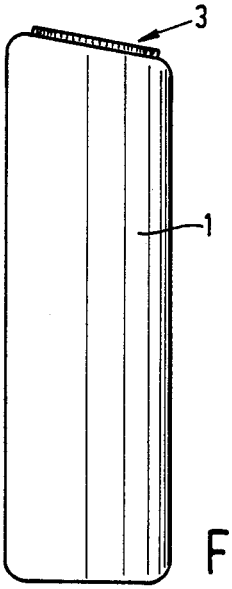
FIG. 5 shows a modification of the embodiment shown in FIGS. 1 to 4.

It is obvious that the invention may also be applied to a dry-shaving apparatus as shown in FIG. 5 without a shaving head which adjoins the housing in accordance with a vee, but in which the shaving unit 3 is merely inclined relative to said housing 1.

What is claimed is:

1. A shaving apparatus comprising a housing which functions as a grip and a shaving head comprising at least one shaving unit, the shaving unit being in an inclined position relative to the housing, which shaving unit comprises a stationary shaving member with hair-entry apertures and a rotatable shaving member, the rotatable shaving member being coupled to an electric motor by means of a drive spindle comprising two portions which are pivotable relative to one another, including a first drive-spindle portion coupled to the rotatable shaving member and a second drive-spindle portion coupled to the motor, wherein the housing is provided with a bearing by means of which the first drive-spindle portion is maintained in a position in which the direction of the axis of rotation of said portion deviates from the direction of the axis of rotation of the second portion.

2. A shaving apparatus as claimed in claim 1, wherein the bearing forms part of an at least partly flexible sealing element arranged between the housing and the shaving head.

3. A shaving apparatus as claimed in claim 2, wherein both the motor and the second drive-spindle portion are carried by a frame which can be mounted in the housing and which also retains the sealing element.

* * * * *